US007779655B2

(12) United States Patent
Chuang et al.

(10) Patent No.: US 7,779,655 B2
(45) Date of Patent: Aug. 24, 2010

(54) KNIT-BY-DESIGN METHOD AND FABRIC

(75) Inventors: Cheng-Yuan Chuang, Panchiao (TW); Graham Laycock, Grangeford (SG); Raymond S. P. Leung, Hong Kong (CN)

(73) Assignee: INVISTA North America S.á r.l., Wilmington, DE (US)

( * ) Notice: Subject to any disclaimer, the term of this patent is extended or adjusted under 35 U.S.C. 154(b) by 268 days.

(21) Appl. No.: 11/303,594

(22) Filed: Dec. 16, 2005

(65) Prior Publication Data

US 2006/0130532 A1 Jun. 22, 2006

Related U.S. Application Data

(60) Provisional application No. 60/637,815, filed on Dec. 21, 2004.

(51) Int. Cl.
*D04B 1/18* (2006.01)

(52) U.S. Cl. ..... 66/198

(58) Field of Classification Search ..... 66/198, 66/16, 197, 202; 442/306, 304, 313
See application file for complete search history.

(56) References Cited

U.S. PATENT DOCUMENTS 5,687,587 A 11/1997 Michel et al.
5,815,868 A 10/1998 Lee et al.
5,931,023 A * 8/1999 Brach et al. ..... 66/136
5,948,875 A 9/1999 Liu et al.
6,129,876 A * 10/2000 Qin et al. ..... 264/209.5
6,263,707 B1 * 7/2001 Miller et al. ..... 66/171
6,472,494 B2 * 10/2002 Houser et al. ..... 528/61
6,776,014 B1 8/2004 Laycock et al.
7,040,124 B1 * 5/2006 Miller et al. ..... 66/202
7,117,695 B2 * 10/2006 Laycock et al. ..... 66/198

FOREIGN PATENT DOCUMENTS

EP 1437432 A 7/2004

OTHER PUBLICATIONS

Kunde K: "Elastomerverarbeitung Auf Rundstrickmaschinen" Melliand Textilberichte, International Textile Reports, Melliand Textilberichte, Frankfurt Am Main, DE, vol. 73, No. 10, Oct. 1, 1992, pp. 812-814,815, XP000310466 ISSN: 0341-0781 the whole document . . .

* cited by examiner

*Primary Examiner*—Danny Worrell
(74) *Attorney, Agent, or Firm*—Christina W. Geerlof

(57) ABSTRACT

The invention provides a method for knitting fabric with bare spandex comprising: providing bare spandex yarn; providing hard yarn; drafting the bare spandex; knitting fabric from the hard yarn and the drafted bare spandex with the hard yarn and the drafted bare spandex plated in every course; and contacting the knit fabric with a continuous phase aqueous solution under conditions of temperature and pressure for a time sufficient to set the bare spandex without heating the knit fabric on a tenter frame above 160° C. in air having a relative humidity of less than 50%. The invention further provides a bare spandex-containing knit fabric containing spandex in every knit course that has been exposed to manufacturing process temperature no higher than 160° C. as shown by molecular weight analysis of the spandex and that exhibits wash shrinkage of less than about 14%.

20 Claims, 5 Drawing Sheets

KNIT-BY-DESIGN METHOD AND FABRIC

PRIORITY CLAIM

This application claims priority from U.S. provisional application No. 60/637,815 filed on Dec. 21, 2004.

FIELD OF THE INVENTION

This invention relates to a method for making circular-knit elastic fabric comprising spandex and hard yarns, without dry heat setting the fabric as part of the method. More particularly the invention relates to a process to make elastified fabrics which have good elongation, good shrinkage, and weight ranging from 100 to 400 g/m2 by using a hydro-setting step prior to or during the dyeing procedure.

BACKGROUND OF THE INVENTION

Circular single-knit jersey fabrics are used to make underwear and top-weight garments, such as T-shirts. Compared to woven structures, the knit fabric can more easily deform, or stretch, by compressing or elongating the individual knit stitches (comprised of interconnected loops) that form the knit fabric. This ability to stretch by stitch rearrangement adds to the wearing comfort of garments made from knit fabrics. Even when knit fabrics are constructed of 100% hard yarns, such as cotton, polyester, nylon, acrylics or wool, for example, there is some recovery of the knit stitches to original dimensions after imposed forces are removed. However, this recovery by knit stitch rearrangement generally is not complete because hard yarns, which are not elastomeric, do not provide a recovery force to rearrange the knit stitches. As a consequence, single-knit fabrics may experience permanent deformations or 'bagging' in certain garment areas, such as at the elbows of shirtsleeves, where more stretching occurs.

To improve the recovery performance of circular, single-knit fabrics, it is now common to co-knit a small amount of spandex fiber with the companion hard yarn. If heat setting is not used to "set" the spandex, after the fabric is knitted and released from the constraints of the circular knitting machine, the stretched spandex in the fabric will retract to compress the fabric stitches so that the fabric is reduced in dimensions compared to what those dimensions would be if the spandex were not present.

Heat setting is not used for all varieties of weft knit elastic fabrics. In some cases a heavy knit will be desired, such as in double knits/ribs and flat sweater knits. In these cases, some stitch compression by the spandex is acceptable. In other cases, the bare spandex fiber is covered with natural or synthetic fibers in a core-spinning or spindle-covering operation, so that the recovery of the spandex and resultant stitch compression is restrained by the covering. In still other cases, bare or covered spandex is plated only on every second or third knit course, thereby limiting the total recovery forces that compress the knit stitches. In seamless knitting, a process wherein tubular knits are shaped for direct use while being knitted on special machines, the fabric is not heat set because dense, stretchy fabrics are intended. For circular-knit jersey elastic fabrics made for cutting and sewing, however, wherein bare spandex is plated in every course, heat setting is almost always required. Heat setting has disadvantages. Heat setting is an extra cost to finish knit elastic fabrics that contain spandex, versus fabrics that are not elastic (rigid fabrics). Moreover, high spandex heat setting temperatures can adversely affect sensitive companion hard yarns, e.g., yellowing of cotton, thereby requiring more aggressive subsequent finishing operations, such as bleaching. Aggressive bleaching can negatively affect fabric tactile properties, such as "hand," and usually requires the manufacturer to include fabric softener to counteract bleaching. Also, heat-sensitive hard yarns, such as those from polyacryonitrile, wool and acetate, cannot be used in high-temperature spandex heat setting steps, because the high heat setting temperatures will adversely affect such heat-sensitive yarns.

The disadvantages of heat setting have long been recognized, and, as a result, spandex compositions that heat set at somewhat lower temperatures have been identified (U.S. Pat. Nos. 5,948,875 and 6,472,494 B2). For example, the spandex defined in U.S. Pat. No. 6,472,494 B2 has a heat set efficiency greater than or equal to 85% at approximately 175 to 190° C. The heat set efficiency value of 85% is considered a minimum value for effective heat setting. It is measured by laboratory tests comparing the length of stretched spandex before and after heat setting to the before-stretched spandex length. While such lower heat setting spandex compositions provide an improvement, heat setting is still required, and the costs associated with it have not been significantly reduced.

The traditional practice of making and heat setting circular-knit fabrics has further disadvantages. The knit fabric emerges from a circular knitting machine in the form of a continuous tube. As the tube is formed in knitting, it is either rolled under tension onto a mandrel, or it is collected as a flat tube under the knitting machine by plaiting or loose folding. In either case, the fabric establishes two permanent creases where the fabric tube has been folded or flattened. Although the fabric is "opened" by slitting the fabric tube along one of the creases, subsequent use and cutting of the fabric usually must avoid the remaining crease. This reduces the fabric yield (or the amount of knit fabric that can be further processed into garments).

Recent advances in this area include U.S. Pat. No. 6,776,014, which describes the formation of circular knit fabrics suitable for t-shirts. In U.S. Pat. No. 6,776,014, elastified circular knit fabrics are knit using low draft and as a result, there is no heat setting required to achieve stable fabrics. However, the fabrics of U.S. Pat. No. 6,776,014 must be knit at very low spandex yarn tension in order to achieve stable fabrics.

SUMMARY OF THE INVENTION

The invention provides circular knit, single jersey, elastic fabrics that include bare elastomeric material plated with spun and/or continuous filament hard yarns, wherein the circular knit, single jersey, elastic fabrics can be manufactured with commercially acceptable properties without a need for in-fabric elastomeric fiber dry heat setting because: (1) the elastomeric fiber draft can be limited during the knitting process; (2) certain desired single knit fabric parameters can be maintained; and (3) the circular knit, single jersey elastic fabric may be contacted with a continuous phase aqueous solution under conditions of temperature and pressure for a period of time sufficient to substantially set the bare elastomeric material.

The first aspect of the invention includes a method for making circular knit, single jersey elastic fabrics in which bare elastomeric material, such as a bare spandex yarn, from 15 to 156 dtex, for example from 17 to 78 dtex, may be plated with at least one hard yarn of spun and/or continuous filament yarn, or blends thereof, with yarn count (Nm) from 10 to 165, for example from 44 to 68.

The elastomeric material and the hard yarn can be plated to produce a knit fabric such as circular, flat, tricot, ribs, and fleece. The circular knit, single jersey, elastic fabrics produced by this knitting method can have a cover factor of from 1.1 to 1.9. During the knitting, the draft on the elastomeric material feed can be controlled so that the elastomeric material may be drafted no more than about 7×, typically no more than 5×, for example no more than 2.5× its original length when knit to form the circular knit, single jersey, elastic fabrics.

The method further includes a stabilization step which includes applying a hot, hydro-setting treatment to the circular knit, single jersey, elastic fabrics and at a temperature and for a period of time sufficient to allow the elastomeric material in the circular knit, single jersey elastic fabric to undergo a change and become substantially "set". For example, the stabilization step may include hydro-setting circular knit, single jersey, elastic fabrics in a jet dryer to a temperature ranging from about 105° C. to about 145° C. and for a residence time ranging from about 15 minutes to about 90 minutes. The stabilization step re-deniers the spandex to reduce the fabric load and unload power and fabric basis weight. Because of the stabilization step, the circular knit, single jersey, elastic fabrics may not have to undergo a dry heat setting step, such as heating the circular knit, single jersey, elastic fabrics on a tenter frame under tension above about 160° C. in air having a relative humidity of less than about 50%.

Next, the circular knit, single jersey, elastic fabrics may be dyed, finished and/or dried at temperatures below the heat setting temperature of the spandex without dry heat setting the circular knit, single jersey elastic fabric or the spandex within the circular knit, elastic fabric. Finishing may comprise one or more steps, such as cleaning, bleaching, dyeing, drying, napping, brushing, and compacting, and any combination of such steps. Typically, the finishing and drying are carried out at one or more temperatures below 160° C. Drying or compacting is carried out while the circular knit, single jersey, elastic fabrics is in an overfeed condition in the warp direction.

The resulting circular knit, single jersey, elastic fabrics may have an elastomeric material content of from about 3.5% to about 14% by weight based on the total fabric weight per square meter, for example from about 5% to about 14% by weight based on the total fabric weight per square meter. In addition, circular knit, single jersey, elastic fabrics may have a cover factor of from about 1.1 to about 1.9, for example, from about 1.29 to about 1.4.

The second and third aspects of the invention are the circular knit, single jersey, elastic fabrics made according to the inventive method, and garments constructed from such fabrics. The circular knit, single jersey, elastic fabrics produced by the inventive method can be formed with synthetic filament, spun staple yarn of natural fibers, natural fibers blended with synthetic fibers or yarns, spun staple yarn of cotton, cotton blended with synthetic fibers or yarns, spun staple polypropylene, polyethylene or polyester blended with polypropylene, polyethylene or polyester fibers or yarns, and combinations thereof and can have a basis weight of from about 100 to about 400 g/m$^2$, for example of from about 140 to about 240 g/m$^2$. The circular knit, single jersey, elastic fabrics also can have an elongation of about 45% to about 175%, for example from about 60% to about 175% in the length (warp) direction, and a shrinkage after washing and drying of about 15% or less, typically, 14% or less, for example less than about 7% in both length and width. The circular knit, single jersey, elastic fabrics may have been exposed to a temperature no higher than about 160° C. (such as shown by differential scanning calorimetry or molecular weight analysis of the spandex). The circular knit, single jersey, elastic fabrics may be in the form of a tube (as output from a circular knitting process), or in the form of a flat knit. The fabric tube may be slit to provide a flat fabric. The circular knit, elastic fabric typically has a curling value of about 1.0 or less, for example about 0.5 or less face curl. Garments made from the single jersey, elastic fabrics may include swimwear, underwear, t-shirts, and top or bottom-weight garments, such as for ready-to-wear, athletic, or outdoor wear.

The present invention includes a circular knit, single jersey elastic fabric having at least one elastomeric material incorporated therein, wherein the at least one elastomeric material can be drafted no more than about 7×, typically no more than 5×, for example no more than 2.5× its original length, and the circular knit, single jersey elastic fabric can be exposed to a hydro-setting step prior to or during a dyeing procedure.

The present invention further includes a method for producing a circular knit, single jersey elastic fabric having at least one elastomeric material incorporated therein, wherein the method involves drafting the at least one elastomeric material no more than about 7× its original length, and wherein the method includes a hydro-setting step and may not include a dry heat setting step. Fabrics of the present invention may have less than about 50% of the bare spandex contact points fused, typically less than about 30%, for example less than about 10% of the bare spandex contact points fused.

The present invention further includes a circular knit, single jersey elastic fabric having at least one elastomeric material incorporated therein, wherein the circular knit, single jersey, elastic fabrics can be produced in the form of a tube and can exhibit a wash shrinkage of less than about 15%, typically, 14% or less, for example 7% or less. The knit fabric tube can have no side creases formed therein, and the circular knit, elastic fabric can be used for cutting and sewing such fabric into garments.

The present invention further includes a circular knit, single jersey elastic fabric formed of a heat sensitive hard yarn and at least one elastomeric material incorporated therein.

Other features and advantages of the present invention will become apparent from the following detailed description when read in conjunction with the accompanying drawings and appended claims.

BRIEF DESCRIPTIONS OF THE DRAWINGS

Figure 5:
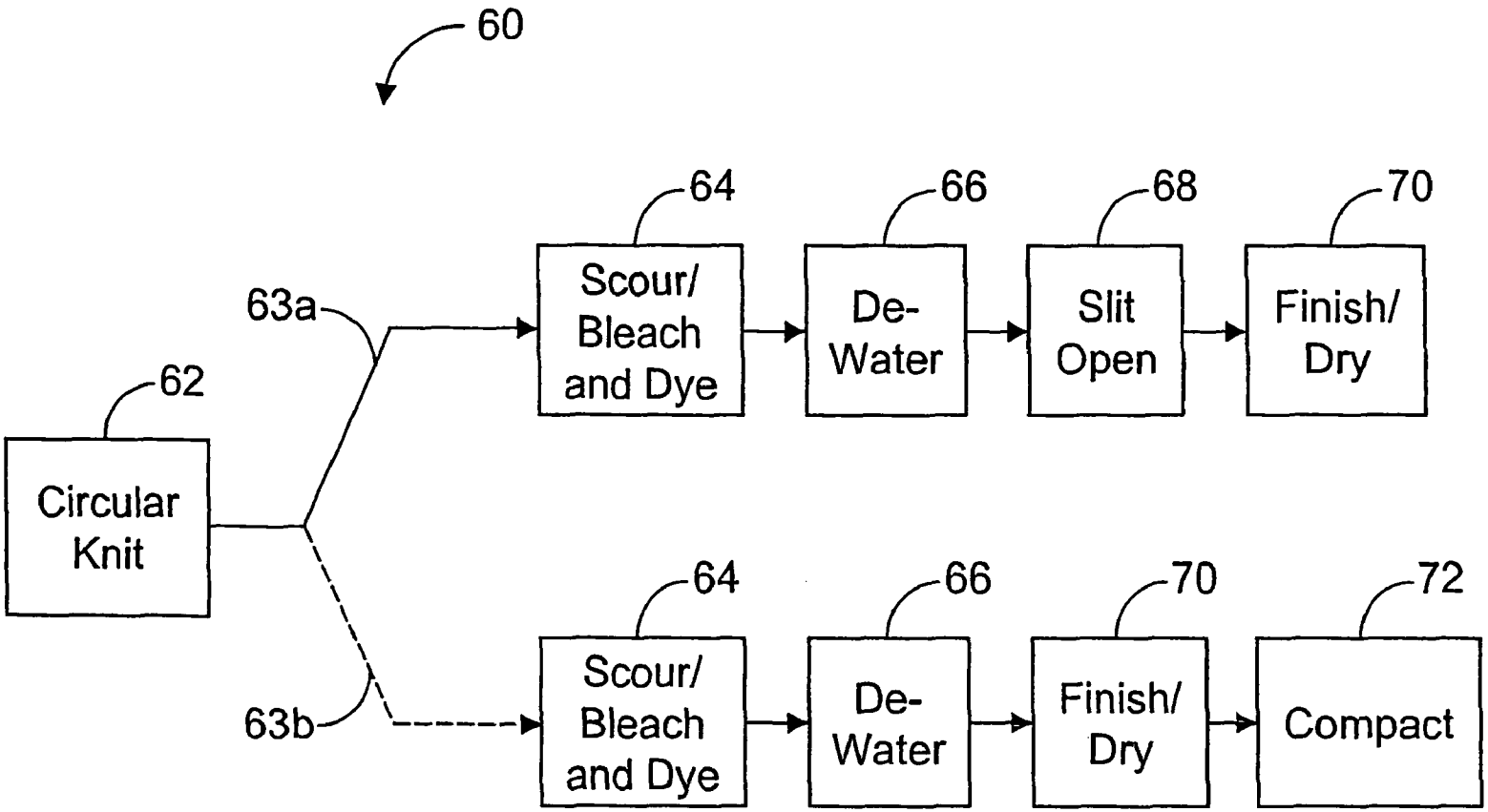

FIG. 5 is a flow chart showing the process steps for making circular-knit, elastic, single-knit jersey fabrics that have bare spandex plated in every knit course according to U.S. Pat. No. 6,776,014.

Figure 6:
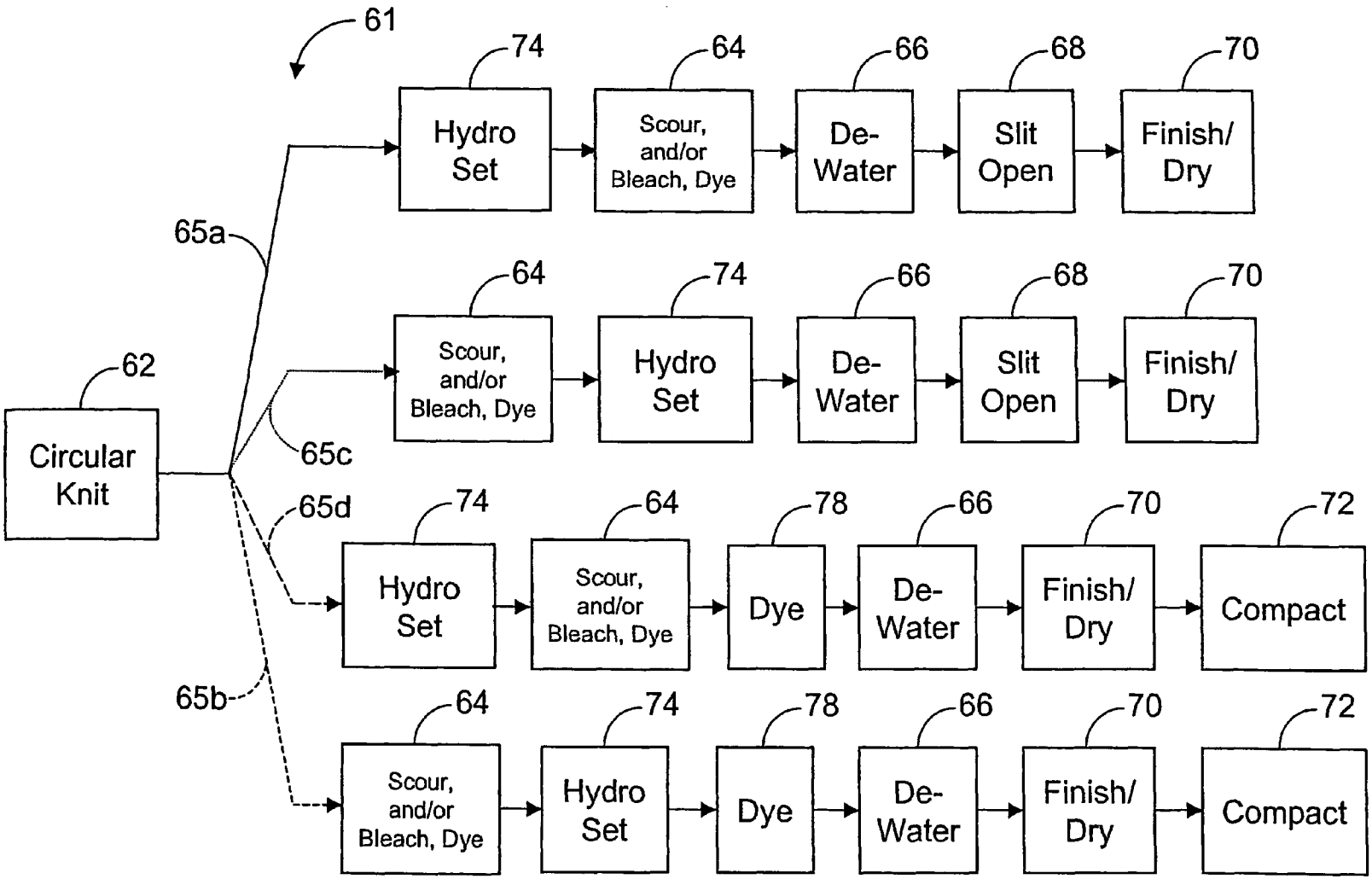

FIG. 6 is a flow chart showing the inventive process steps for making circular-knit, elastic, single-knit jersey fabrics that have bare spandex plated in every knit course.

DETAILED DESCRIPTION

The following terms are used in the specification to describe aspects of textile technology. As used herein, "draft"

refers to the amount of stretch applied to the spandex. The draft of a fiber is directly related to the elongation (stretching) applied to the fiber (e.g. 100% elongation corresponds to 2× draft, 200% elongation corresponds to 3× draft, etc). As used herein, "spandex" means a manufactured fiber in which the fiber-forming substance is a long-chain synthetic polymer comprised of at least 85% of segmented polyurethane. The polyurethane can be prepared from a polyether glycol, a mixture of diisocyanates, and a chain extender and then melt-spun, dry-spun or wet-spun to form the spandex fiber, but is not limited to polyurethane urea fibers. As used herein, "warp" means the length direction of the fabric and "weft" means the width direction of the fabric. As used herein, "hard yarn" means a knitting yarn, which does not contain a high amount of elastic stretch, such as a spun cotton yarn or a nylon synthetic fiber. As used herein, the terms "molecular weight analysis" and "differential scanning calorimetry" refer to methods for determining the highest temperature at which a sample of spandex has been exposed. The term "molecular weight analysis" refers to a method of analyzing the molecular weight of an elastomeric material and correlating that to the thermal history of the elastomeric material. The term "differential scanning calorimetry" refers to a measurement of the amount of energy (heat) absorbed or released by a sample as it is heated, cooled, or held at a constant temperature.

Figure 1:
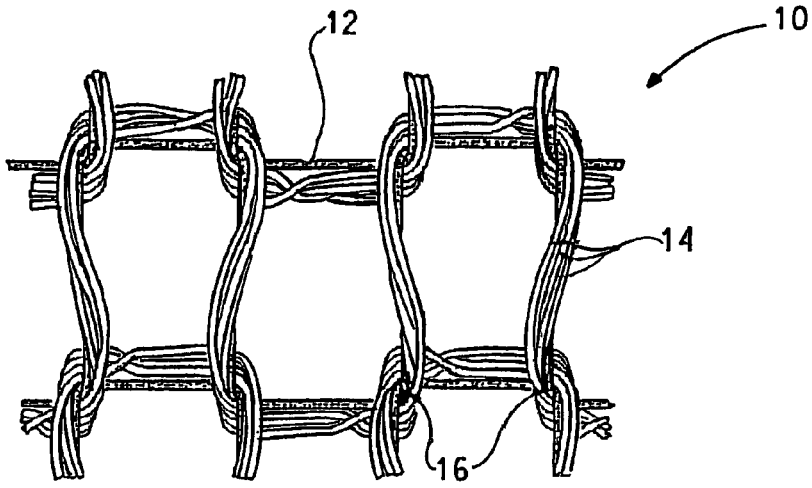
FIG. 1 illustrates plated knit stitches comprising a hard yarn and spandex.

For jersey knit constructions in circular knit machines, the process of co-knitting spandex is called "plating." With plating, the hard yarn and the bare spandex yarn are knitted parallel, side-by-side relation, with the spandex yarn always kept on one side of the hard yarn, and hence on one side of the knitted fabric. FIG. 1 is a schematic representation of plated knit stitches 10 wherein the knitted yarn comprises spandex 12 and a multi-filament hard yarn 14. When spandex is plated with hard yarn to form a knit fabric, additional processing costs are incurred beyond the added cost of the spandex fiber. For example, fabric stretching and heat setting usually are required in the finishing steps when making elastic knit jersey fabrics.

The term "circular knitting" means a form of weft knitting in which the knitting needles are organized into a circular knitting bed. Generally, a cylinder rotates and interacts with a cam to move the needles reciprocally for knitting action. The yarns to be knitted are fed from packages to a carrier plate that directs the yarn strands to the needles. The circular knit fabric emerges from the knitting needles in a tubular form through the center of the cylinder.

Figure 4:
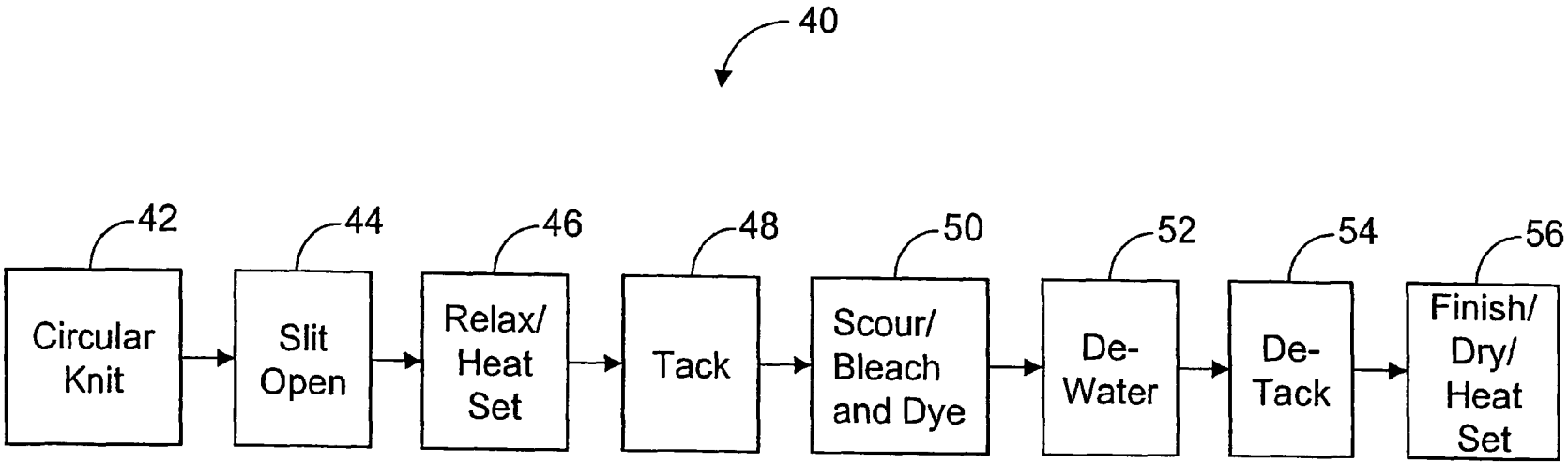
FIG. 4 is a flow chart showing process steps for making circular-knit, elastic, single-knit jersey fabrics that have bare spandex plated in every knit course.

The steps for making elastic circular-knit fabrics according to one known process 40 are outlined in FIG. 4. Although process variations exist for different fabric knit constructions and fabric end uses, the steps shown in FIG. 4 are representative for making jersey knit elastic fabrics with spun hard yarns, such as cotton. The fabric is first circular knit 42 at conditions of high spandex draft and feed tensions. For example, for single-knit jersey fabrics made with bare spandex plated in every knit course, the typical feed tension range is 2 to 4 cN for 22 dtex spandex; 3 to 5 cN for 33 dtex; and 4 to 6 cN for 44 dtex. The fabric is knit in the form of a tube, which is collected under the knitting machine either as a roll on a rotating mandrel as a flattened tube, or in a box after it is loosely folded back and forth.

In open-width finishing, the knitted tube is then slit open 44 and laid flat. The open fabric is subsequently relaxed 46, either by subjecting it to steam, or by wetting it by dipping and squeezing (padding). The relaxed fabric is then applied to a tenter frame and heated (for heat setting 46) in an oven. The tenter frame holds the fabric on the edges by pins, and stretches it in both the length and width directions in order to return the fabric to desired dimensions and basis weight. If wet, the fabric is first dried, than then heat setting is accomplished before subsequent wet processing steps. Consequently, heat setting is often referred to as "pre-setting" in the trade. At the oven exit, the flat fabric is released from the stretcher and then tacked 48 (sewed) back into a tubular shape. The fabric then is processed in tubular form through wet processes 50 of cleaning (scouring) and optional bleaching/dyeing, e.g., by soft-flow jet equipment, and then dewatered 52, e.g., by squeeze rolls or in a centrifuge. The fabric is then "de-tacked" 54 by removing the sewing thread and re-opening the fabric into a flat sheet. The flat, still wet, fabric is then dried 56 in a tenter-frame oven under conditions of fabric overfeed (opposite of stretching) so that the fabric is under no tension in the length (machine) direction while being dried at temperatures below heat setting temperatures. The fabric is slightly tensioned in the width direction in order to flatten any potential wrinkling. An optional fabric finish, such as a softener, may be applied just prior to the drying operation 56. In some cases a fabric finish is applied after the fabric is first dried by a belt or tenter-frame oven, so that the finish is taken up uniformly by fibers that are equally dry. This extra step involves re-wetting the dried fabric with a finish, and then drying the fabric again in a tenter-frame oven.

Heat setting of dry fabric in a tenter frame or other drying apparatus "sets" spandex in an elongated form. This is also known as re-deniering, wherein a spandex of higher denier is drafted, or stretched, to a lower denier, and then heated to a sufficiently high temperature, for a sufficient time, to stabilize the spandex at the lower denier. Heat setting therefore means that the spandex permanently changes so that recovery tension in the stretched spandex is mostly relieved and the spandex becomes stable at a new and lower denier. Heat setting temperatures for spandex are generally in the range of about 175 to about 200° C. For the process 40 shown in FIG. 4, the heat setting 46 commonly is for about 45 seconds or more at about 190° C.

Compression of the stitches in the knitted fabric has three major effects that are directly related to elastic knit fabric properties, and thereby usually renders the fabric inappropriate for subsequent cut and sew operations.

First, stitch compression reduces fabric dimensions and increases fabric basis weight (g/m$^2$) beyond desired ranges for single jersey knit fabrics for use in garments. As a result, the traditional finishing process for elastic circular-knit fabric includes a fabric stretching and heating step, at sufficiently high temperatures and sufficiently long residence time, so that the spandex yarn in the knit will "set" at desired stretched dimensions. After heat setting, the spandex yarn will either not retract, or will retract only modestly below its heat-set dimension. Thus, the heat-set spandex yarn will not significantly compress the knit stitches from the heat-set dimensions. Stretching and heat setting parameters are chosen to yield the desired fabric basis weight and elongation, within relatively tight limits. For a typical cotton-jersey elastic single-knit, the desired elongation is at least 60%, and the basis weight ranges from about 100 to about 400 g/m$^2$. Second, the more severe the stitch compression, the more the fabric will elongate on a percentage basis, thus far exceeding minimum standards and practical needs. When a plated knit with elastic yarn is compared with a fabric knit without elastic yarn, it is common for the plated elastic knit fabric to be 50% shorter (more compressed) than the fabric without elastic yarn. The plated knit is able to stretch in length 150% or more from this compressed state, and such excessive elongation is generally undesirable in jersey knits for cut and sew applications. This length is in the warp direction of the fabric. Fabrics with high elongation in length (stretch) are more likely to be cut irregularly, and are also more likely to shrink excessively upon washing. Similarly, stitches are compressed by spandex in the width direction, so that fabric width is reduced about 50% as well, far beyond the 15 to 20% as-knit width reduction normally encountered with rigid (non-elastic) fabrics.

Figure 2:
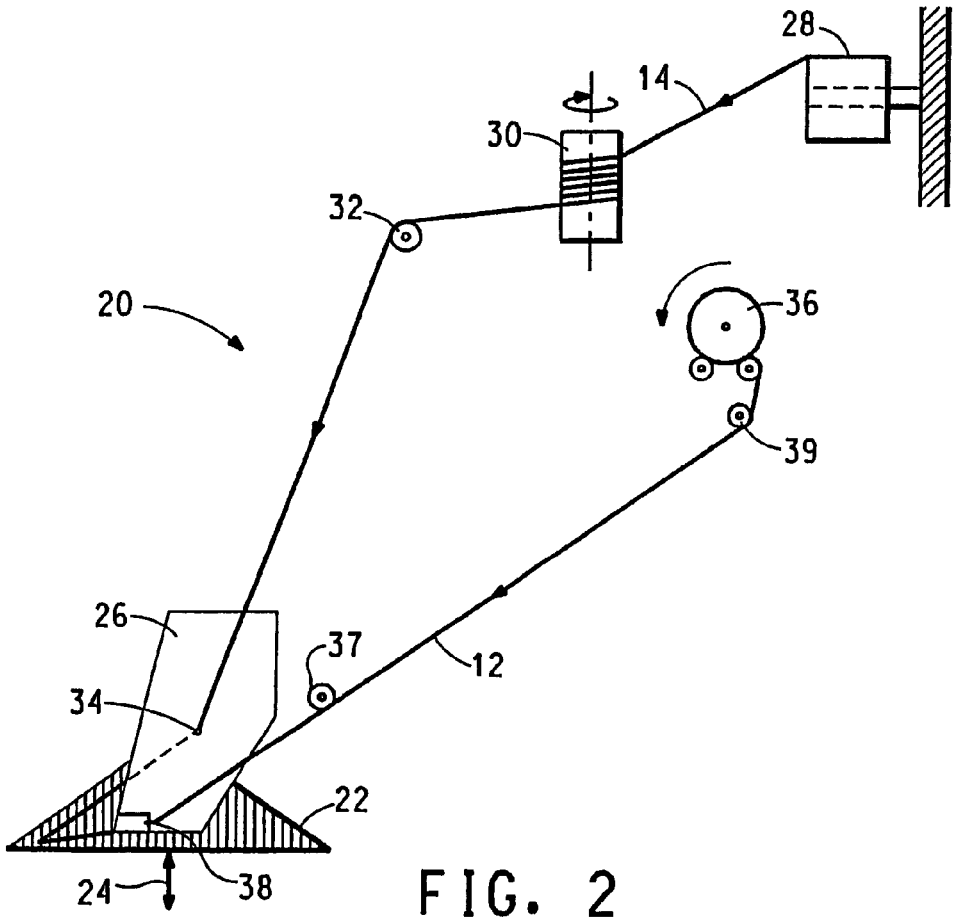
FIG. 2 is a schematic diagram of a portion of a circular knitting machine fed with a spandex feed and a hard yarn feed.

Third, the compressed stitches in the finished fabric are at an equilibrium condition between spandex recovery forces and resistance to stitch compression by the companion hard yarn. Washing and drying of the fabric can reduce the hard-yarn resistance, probably in part because of agitation of the fabric. Thus, washing and drying may permit the spandex recovery forces to further compress the knit stitches, which can result in unacceptable levels of fabric shrinkage. Heat setting the knit fabric serves to relax the spandex and reduce the spandex recovery force. The heat setting operation therefore improves the stability of the fabric, and reduces the amount that the fabric will shrink after repeated washings. The present invention can provide process for making circular-knit elastic fabric comprising spandex and hard yarns without requiring setting. The resulting fabric may have superior performance relative to known fabrics in terms of achieving fabric basis weight of about 100 g/m2 to about 400 g/m2 with reduced fabric shrinkage and acceptable fabric elongation. Additionally, an improvement in fabric curling is found when hydro setting is applied to fabrics with a final weight of 100 to 400 g/m2. Regarding circular knitting, FIG. 2 shows in schematic form one feed position 20 of a circular knitting machine having a series of knitting needles 22 that move reciprocally as indicated by the arrow 24 in response to a cam (not shown) below a rotating cylinder (not shown) that holds the needles. In a circular knitting machine, there are multiple numbers of these feed positions arranged in a circle, so as to feed individual knitting positions as the knitting needles, carried by the moving cylinder, are rotated past the positions.

For plating knit operations, a spandex yarn 12 and a hard yarn 14 are delivered to the knitting needles 22 by a carrier plate 26. The carrier plate 26 simultaneously directs both yarns to the knitting position. The spandex yarn 12 and hard yarn 14 are introduced to the knitting needles 22 to form a single jersey knit stitch 10 like that shown in FIG. 1.

The hard yarn 14 is delivered from a wound yarn package 28 to an accumulator 30 that meters the yarn to the carrier plate 26 and knitting needles 22. The hard yarn 14 passes over a feed roll 32 and through a guide hole 34 in the carrier plate 26. Optionally, more than one hard yarn may be delivered to the knitting needles via different guide holes in the carrier plate 26.

The spandex 12 is delivered from a surface driven package 36 and past a broken end detector 39 and change of direction roll(s) 37 to a guide slot 38 within the carrier plate 26. The feed tension of the spandex 12 is measured between the detector 39 and drive roll 37, or alternatively between the surface driven package 36 and roll 37 if the broken end detector is not used. The guide hole 34 and guide slot 38 are separated from one another in the carrier plate 26 so as to present the hard yarn 14 and spandex 12 to the knitting needles 22 in side by side, generally parallel relation (plated).

Commercially available elastane products for circular knitting are useful in the invention. Examples of commercially available brands include Lycra® (a registered trademark of Invista S. à r.l.) types 162, 169 and 562 (available from Invista S. à r.l.).

The spandex stretches (drafts) when it is delivered from the supply package to the carrier plate and in turn to the knit stitch due to the difference between the stitch use rate and the feed rate from the spandex supply package. The ratio of the hard yarn supply rate (meters/min) to the spandex supply rate is normally 2.5 to 4 times (2.5× to 4×) greater, and is known as the machine draft. This corresponds to spandex elongation of 150% to 300%, or more. The feed tension in the spandex yarn is directly related to the draft of the spandex yarn. This feed tension is typically maintained at values consistent with high machine drafts for the spandex. We found that improved results are obtained when the total spandex draft, as measured in the fabric, is kept to about 7× or less, typically 3× or less, for example 2.5× or less. This draft value is the total draft of the spandex, which includes any drafting or drawing of the spandex that is included in the supply package of as-spun yarn. The value of residual draft from spinning is termed package relaxation, "PR", and it typically ranges from 0.05 to 0.15 for the spandex used in circular knit, elastic, single jersey fabrics. The total draft of the spandex in the fabric is therefore MD*(1+PR), where "MD" is the knitting machine draft. The knitting machine draft is the ratio of hard yarn feed rate to spandex feed rate, both from their respective supply packages.

Because of its stress-strain properties, spandex yarn drafts more as the tension applied to the spandex increases; conversely, the more that the spandex is drafted, the higher the tension in the yarn. A typical spandex yarn path, in a circular knitting machine, is schematically shown in FIG. 2. The spandex yarn 12 is metered from the supply package 36, over or through a broken end detector 39, over one or more change-of-direction rolls 37, and then to the carrier plate 26, which guides the spandex to the knitting needles 22 and into the stitch. There is a build-up of tension in the spandex yarn as it passes from the supply package and over each device or roller, due to frictional forces imparted by each device or roller that touches the spandex. The total draft of the spandex at the stitch is therefore related to the sum of the tensions throughout the spandex path.

The spandex feed tension is measured between the broken end detector 39 and the roll 37 shown in FIG. 2. Alternatively, the spandex feed tension is measured between the surface driven package 36 and roll 37 if the broken end detector 39 is not used. The higher this tension is set and controlled, the greater the spandex draft will be in the fabric, and vice versa. For example, this feed tension can range from 2 to 4 cN for 22 dtex spandex and from 4 to 6 cN for 44 dtex spandex in commercial circular knitting machines. With these feed tension settings and the additional tensions imposed by subsequent yarn-path friction, the spandex in commercial knitting machines will be drafted significantly more than 3×.

Minimizing the spandex friction between the supply package and the knit stitch helps to keep the spandex feed tensions sufficiently high for reliable spandex feeding when the spandex draft is 7× or less. For reliably feeding spandex from the supply package to the knit stitch, the spandex draft is typically 3× or less.

After knitting a circular knit elastic, single jersey fabric of plated spandex with hard yarn, the fabric is finished in either of the alternate processes 61 illustrated diagrammatically in FIG. 6.

The second aspect of the invention is a hot water setting treatment, 74, which can be carried out immediately before or after the scouring and bleaching step 64, FIG. 6. The fabric is treated with hot water in a jet dyer for a period of 15 to 90 minutes at a water temperature of 105 to 145° C. and pressure not over 4.0 kg/cm$^2$. During said hydro-setting, fabric may be run through the jet as if it was being dyed, but without adding dye. Alternatively, the hydro-setting step may include contacting the fabric with aqueous dye solution. In a jet dyer, a loop of tubular knit fabric is moved in and out of the liquid bath by action of a venturi jet that uses the bath liquid (or alternately air) to forward the fabric. During this hydro-setting process 74, the spandex fiber within the fabric is exposed to wet thermal conditions such that properties of the spandex change. The denier of the fiber and the elastic strength of the fiber decrease. The load power of the spandex after hydro-setting decreases by about 40% while the unload force is decreased by about 20% relative to non-hydro set fiber. Fabric is then dyed or scoured in the same jet dyer, paths 65*a*, 65*b*, 65*c*, or 65*d*. If a hydro-setting step is not used as in paths 63*a* and 63*b*, then the basis weight for the finished fabrics would be higher, see Examples.

Drying operations can be carried out on circular knit fabric 70 in the form of an open width web (top two rows of diagram, paths 65*a*, 65*c*), or as a tube (bottom two rows of diagram, paths 65*b*, 65*d*). For either of these paths, wet finishing process steps 64 (such as scouring, bleaching and/or dyeing) are carried out on the fabric while it is in tubular form. One form of dyeing, called soft-flow jet dyeing, usually imparts tension and some length deformation in the fabric. Care should be taken to minimize any additional tension applied during fabric processing and transport from wet finishing to the dryer, and also enable the fabric to relax and recover from such wet-finishing and transport tensions during drying.

Following wet finishing process steps 64, the fabric is de-watered 66, such as by squeezing or centrifuging. In process paths 65*a* and 65*c*, the tubular fabric is then slit open 68 before it is delivered to a finish/dry step 70 for optional finish application (e.g., softener by padding) and subsequent drying in a tenter-frame oven under conditions of fabric length overfeed. In process paths 65*b* and 65*d*, the tubular fabric is not slit open, but is sent as a tube to the finish/dry step 70. Finish, such as softener, can be optionally applied by padding. The tubular fabric is sent through a drying oven, e.g., lie on a belt, and then to a compactor to separately provide fabric overfeed. A compactor commonly uses rolls to transport the fabric, usually in a steam atmosphere. The first roll(s) is driven at a faster speed of rotation than the second roll(s) so that the fabric is overfed into the compactor. Generally, the steam does not "re-wet" the fabric so that no additional drying is required after compacting.

The drying step 70 (paths 65*a* and 65*c*) or the compacting step 72 (paths 65*b* and 65*d*), is operated with controlled, high fabric overfeed in the length (machine) direction so that the fabric stitches are free to move and rearrange without tension. A flat, non-wrinkled or non-buckled fabric emerges after drying. These techniques are familiar to those skilled in the art. For open width fabrics, a tenter-frame is used to provide fabric overfeed during drying. For tubular fabrics, forced overfeed is typically provided in a compactor 72, after belt drying. In either open-width or tubular fabric processing, the fabric drying temperature and residence time are set below the values required to heat set the spandex.

Figure 3:
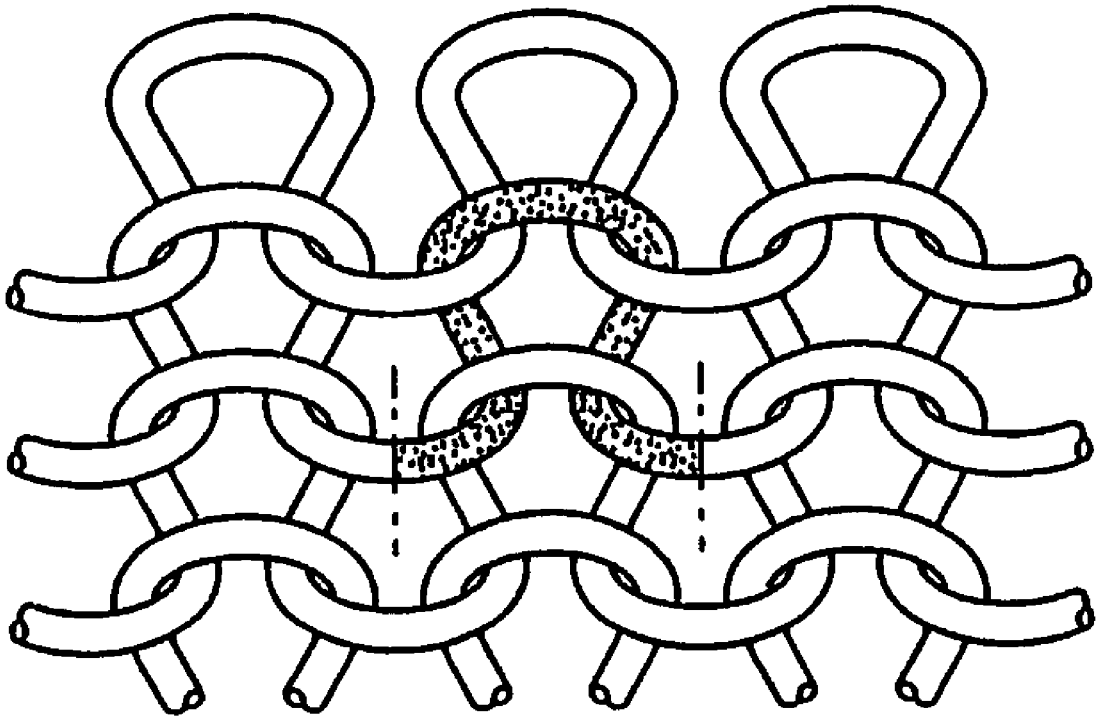
FIG. 3 illustrates a series of single jersey knit stitches and highlights one stitch of stitch length "L".

The structural design of a circular knit fabric can be characterized in part by the "openness" of each knit stitch. This "openness" is related to the percentage of the area that is open versus that which is covered by the yarn in each stitch (see, e.g., FIGS. 1 and 3), and is thus related to fabric basis weight and elongation potential. For rigid, non-elastic weft knit fabrics, the Cover Factor ("Cf") is well known as a relative measure of openness. The Cover Factor is a ratio and is defined as:

$$Cf=\sqrt{(\text{tex})}\div L$$

where tex is the grams weight of 1000 meters of the hard yarn, and L is the stitch length in millimeters. FIG. 3 is a schematic of a single knit jersey stitch pattern. One of the stitches in the pattern has been highlighted to show how the stitch length, "L" is defined. For yarns of metric count Nm, the tex is 1000÷Nm, and the Cover Factor is alternatively expressed as follows:

$$Cf=\sqrt{(1000/\text{Nm})}\div L.$$

The method of the invention may produce commercially useful circular knit, elastic, single jersey fabrics plated from bare spandex and a hard yarn without a dry heating step above about 160° C., when the spandex draft is kept about 7× or less and a hydro-setting operation is added. The following process conditions are suitable.

- The Cover Factor, which characterizes the openness of the knit structure, can be between about 1.1 and about 1.9, for example 1.4.
- The hard yarn count, Nm, can be from 10 to 165, for example from 47 to 54.
- The spandex can be from 15 to 156 dtex, for example 22 to 33 dtex.
- The content of spandex in the fabric, on a % weight basis, can be from 3.5% to 14%, for example from 5% to 12%.
- The hot, hydro-setting treatment can be applied to knit fabric in a jet dyer for 15 to 90 minutes at temperatures of about 105 to about 145° C.
- The knit fabric so formed can have a shrinkage after washing and drying of about 14% or less, for example less than 7% in both the length and width directions.
- The knit fabric can have an elongation of about 60% or more, typically from about 60% to about 130%, in the length (warp) direction.
- The hard yarn can be filament nylon, spun staple yarn of cotton or cotton blended with synthetic fibers or yarns.

While not wishing to be bound by any one theory, it is believed that the hard yarn in the knit structure resists the spandex force that acts to compress the knit stitch. The effectiveness of this resistance is related to the knit structure, as defined by the Cover Factor. For a given hard yarn count, Nm, the Cover Factor is inversely proportional to the stitch length, L. This length is adjustable on the knitting machine, and is therefore a key variable for control.

In the process of the invention, the spandex draft can be the same in a circular knit, elastic, single jersey as-knit fabric, the finished fabric, or at fabric-processing steps in-between, within the limits of measurement error.

For a circular knit, elastic, single jersey fabric, the appropriate gauge of knitting machine can be selected according to known relationships between hard yarn count and knitting machine gauge. Choice of gauge can be used to optimize circular knit, elastic, single jersey basis weight, for example.

The use of a softener is optional, but commonly a softener can be applied to the knit fabric to further improve fabric hand, and to increase mobility of the knit stitches during drying. Softeners such as SURESOFT SN (Surry Chemical) or SANDOPERM SE1® (Clairant) are typical. The fabric may be passed through a trough containing a liquid softener composition, and then through the nip between a pair a pressure rollers (padding rollers) to squeeze excess liquid from the fabric.

The method of the invention may provide circular knit, elastic, single jersey fabrics that, when collected by folding (plaiting), do not crease to the same extent as similar circular knit single jersey fabrics produced by other methods. Fewer or less visible fold creases in the finished fabric can result in an increased yield for cutting and sewing the fabric into garments. The circular knit, elastic, single jersey fabrics of the invention may also exhibit significantly reduced skew during process in either open-width or tubular finishing processes, compared to fabrics produced by other methods. With excess skew or spirality, fabrics are diagonally deformed and courses are "on the bias", and are unacceptable. Garments made with skewed fabric will twist on the body.

EXAMPLES

The following non-limiting examples demonstrate methods and fabrics of the invention. The invention is capable of other and different embodiments, and its several details are capable of modifications in various apparent respects, without departing from the scope and spirit of the present invention. Accordingly, the examples are to be regarded as illustrative in nature and not as restrictive.

Fabric Knitting and Finishing

Circular knit elastic single jersey fabrics with bare spandex plated with hard yarn for the examples are knit on Pai Lung Circular Knitting Machine Model PL-FS3B/T, with 16 inch cylinder diameter, 28 gauge (needles per circumferential inch), and 48 yarn feed positions. The circular knit machine is operated at 24 revolutions per minute (rpm).

The broken end detector in each spandex feed path (see FIG. 2) is either adjusted to reduce sensitivity to yarn tension, or removed from the machines for these examples. The broken end detector is a type that contacted the yarn, and therefore induced tension in the spandex.

The spandex feed tension is measured between the spandex supply package 36 and the roller guide 37 (FIG. 2) with a Zivy digital tension meter, model number, EN-10. For the following examples, the spandex feed tensions are maintained at 1-3 grams or less for 20, 30, and 40-denier spandex. These tensions are sufficient for reliable and continuous feeding of the spandex yarn to the knitting needles, and sufficiently low to draft the spandex only about (or 7×) 3× or less. When the feed tensions are too low, the spandex yarn wraps around the roller guides at the supply package and cannot be reliably fed to the circular knitting machine.

All the knitted fabrics are scoured, hydro set (or hydro set, scoured), dyed and dried, either per the open-width processes 65*a* and 65*c* or as a tube, 65*b* and 65*d* of FIG. 6. Knitted fabrics 1, 7, 13, and 19 are finished according to the process in path 65*a*. Knitted fabrics 4, 10, 16, and 22 are finished according the process in path 63*b*. Knitted fabrics 2, 3, 8, 9, 14, 15, 20, and 21 were finished according to the process in path 65*a*. Knitted fabrics 5, 6, 11, 12, 17, 18, 23, and 24 are finished according to the process in path 65*b*.

Fabrics are scoured and bleached in a 300-liter solution at 100° C. for 30 minutes. All such wet, jet finishing, including hydro setting, dyeing, is done in a Tong Geng machine (Taiwan) Model TGRU-HAF-30. The water solution contained Stabilizer SIFA (300 g) (silicate free alkaline), NaOH (45%, 1200 g), $H_2O_2$ (35%, 1800 g), IMEROL ST (600 g) for cleaning, ANTIMUSSOL HT2S (150 g) for antifoaming, and IMACOL S (150 g) for anticreasing. After 30 minutes, the solution and fabric are cooled to 75° C. and then the solution was drained. The fabric was subsequently neutralized in a 300 liter solution of water and HAC (150 g) (hydrogen+dona, acetic acid) at 60° C. for 10 minutes. After scouring, new fresh water is added to the jet for the hydroset step, 74 in FIG. 6. The fabric is run in the jet with water at about 105° C. to about 140° C. for about 15 to about 90 minutes.

The fabrics are dyed in a 300-liter solution of water at 60° C. for 60 minutes, using reactive dyestuffs and other constituents. The dye solution contained R-3BF (215 g), Y-3RF (129 g), $Na_2SO_4$ (18,000 g), and $Na_2CO_3$ (3000 g). After 10 minutes, the dyebath is drained and refilled to neutralize with HAC (150 g) for 10 minutes at 60° C. After neutralization, the bath is again drained and refilled with clean water for a 10-minute rinse. Subsequent to neutralization, the 300-liter vessel was again filled with water, and 150 g of SANDOPUR RSK (soap) is added. The solution is heated to 98° C., and the fabrics are washed/soaped for 10 minutes. After draining and another 10 minute clean-water rinse, the fabrics are unloaded from the vessel.

The wet fabrics are then de-watered by centrifuge, for 8 minutes.

For the final step, a lubricant (softener) is padded onto the fabrics in a 77-liter water solution with SANDOPERM SEI liquid (1155 g) (or Suresoft SE). The fabrics are then dried in a tenter oven at 145° C. for about 30 seconds, at 50% overfeed.

The above procedure and additives will be familiar to those experienced in the art of textile manufacturing, and circular knitting of single jersey knit fabrics.

Test Methods

Spandex Draft

The following procedure, conducted in an environment at 20° C. and 65% relative humidity, is used to measure the spandex drafts in the Examples.

- De-knit (unravel) a yarn sample of 200 stitches (needles) from a single course, and separate the spandex and hard yarns of this sample. A longer sample is de-knit, but the 200 stitches are marked at beginning and end.
- Hang each sample (spandex or hard yarn) freely by attaching one end onto a meter stick with one marking at the top of the stick. Attach a weight to each sample (0.1 g/denier for hard yarn, 0.001 g/denier for spandex). Lower the weight slowly, allowing the weight to be applied to the end of the yarn sample without impact.
- Record the length measured between the marks. Repeat the measurements for 5 samples each of spandex and hard yarn.
- Calculate the average spandex draft according to the following formula:

Draft=(Length of hard yarn between marks)÷(Length of spandex yarn between marks).

Conventional dry heat setting under certain conditions can make it impossible to measure the in-fabric spandex draft. This is because high temperatures for spandex dry heat setting can soften the spandex yarn surface and the bare spandex can tack to itself at stitch crossover points 16 in the fabric (FIG. 1). If this occurs, one cannot de-knit fabric courses and extract yarn samples.

Fabric Weight

Knit Fabric samples are die-punched with a 10 cm diameter die. Each cut-out knit fabric sample is weighed in grams. The "fabric weight" is then calculated as grams/square meters.

Spandex Fiber Content

Knit fabrics are de-knit manually. The spandex is separated from the companion hard yarn and weighed with a precision laboratory balance or torsion balance. The spandex content is expressed as the percentage of spandex weight to fabric weight.

Fabric Elongation

The elongation is measured in the warp direction only. Three fabric specimens are used to ensure consistency of results. Fabric specimens of known length are mounted onto a static extension tester, and weights representing loads of 4 Newtons per centimeter of length are attached to the specimens. The specimens are exercised by hand for three cycles and then allowed to hang free. The extended lengths of the weighted specimens are then recorded, and the fabric elongation is calculated.

Shrinkage

Two specimens, each of 60×60 centimeters, are taken from the knit fabric. Three size marks are drawn near each edge of the fabric square, and the distances between the marks are noted. The specimens are then sequentially machine washed 3 times in a 12-minute washing machine cycle at 40° C. water temperature and air dried on a table in a laboratory environment. The distances between the size marks are then remeasured to calculate the amount of shrinkage.

Face Curl

A 4-inch×4-inch (10.16 cm×10.16 cm) square specimen is cut from the knit fabric. A dot is placed in the center of the square, and an 'X' is drawn with the dot as the center of the 'X'. The legs of the 'X' are 2 (5.08 cm) inches long and in line with the outside corners of the square. The X is carefully cut with a knife, and then the fabric face curls of two of the internal points created by the cut are measured immediately and again in two minutes, and averaged. If the fabric points curl completely in a 360° circle, the curl is rated as 1.0; if it curls only 180°, the curl is rated ½; and so on.

Molecular Weight Analysis

The molecular weight of a spandex fiber can be determined via the following method. An Agilent Technologies 1090 LC (liquid chromatograph, Agilent Technologies, Palo Alto, Calif.) equipped with a UV detector fitted with a 280 nanometer filter in a filter photometric detector and 2 Phenogel™ columns (300 mm×7.8 mm packed with 5 micron column packing of styrene and divinyl benzene in a linear/mixed bed (Phenomex®, Torrance, Calif.), is used to analyze the molecular weight of spandex polymers. Samples are run in mobile phase at a flow rate of 1 ml/min and at a column temperature of 60° C. The sample for analysis is prepared in using 2.0-3.0 milligrams of polymer per milliliter of solvent. A 50 microliter sample of polymer solution is injected into the LC for analysis. The resulting chromatographic data is analyzed using Viscotek 250 GPC software (Viscotek, Houston, Tex.).

The LC is calibrated using a Hamielec Broad standard calibration method and a broad standard of polyurethane/urea polymer of stable molecular weight, containing no finish, additives, or pigments. The broad standard is fully characterized for weight average molecular weight (104,000 daltons) and number average molecular weight (33,000 daltons) before use as a standard.

Differential Scanning Calorimetry

This procedure induced four temperatures into the same specimen of spandex without removing the sample from the differential scanning calorimeter (DSC). The DSC instrument was a Perkin Elmer Differential Scanning Calorimeter Model Pyris 1, commercially available from Perkin Elmer (Wellesley, Mass.). The instrument was programmed to start at 50° C. and heat to 140, 160, 180 and 200° C. with a one minute hold at each temperature. The sample was cooled to the starting temperature of 50° C. after each endotherm is scanned, then held at 50° C. for five minutes prior to scanning the next higher temperature.

The specimen was then scanned from 50° C. to 240° C. to locate the endotherms that are induced in the prior test. Each endotherm was found ±3° C. The variance in the endotherms found versus the temperature induced was within the tolerance of the DSC instrument.

Examples 1-10

Table 1 below sets forth the knitting conditions for the example knit fabrics. Lycra® types 169 or 562 are used for the spandex feeds. Lycra® denier is 20 or 22 dtex. The stitch length, L, is a machine setting. Table 2 below summarizes key results of the tests for finished fabrics. Values of curl were acceptable for all test conditions. Spandex feed tensions are listed in grams. 1.00 grams equal 0.98 centiNewtons (cN).

TABLE 1

KNITTING CONDITIONS

| Example | Spandex Lycra ® Type | Lycra ® Denier | Hard Yarn Continuous Filament-Type | Spun Yarn Count, denier | Knitting Stitch Length, L, mm | Cover Factor, Cf | Lycra ® Feed Tension, grams | Machine Gauge, needles per inch |
|---|---|---|---|---|---|---|---|---|
| 1 | T169B | 20 | Cotton | 165 | 3.06 | 1.40 | 1.50 | 28 |
| 2 | T169B | 20 | Cotton | 165 | 3.06 | 1.40 | 1.50 | 28 |
| 3 | T169B | 20 | Cotton | 165 | 3.06 | 1.40 | 1.50 | 28 |
| 4 | T169B | 20 | Cotton | 165 | 3.06 | 1.40 | 1.50 | 28 |
| 5 | T169B | 20 | Cotton | 165 | 3.06 | 1.40 | 1.50 | 28 |
| 6 | T169B | 20 | Cotton | 165 | 3.06 | 1.40 | 1.50 | 28 |
| 7 | T562B | 20 | Cotton | 165 | 3.06 | 1.40 | 2.05 | 28 |
| 8 | T562B | 20 | Cotton | 165 | 3.06 | 1.40 | 2.05 | 28 |
| 9 | T562B | 20 | Cotton | 165 | 3.06 | 1.40 | 2.05 | 28 |
| 10 | T562B | 20 | Cotton | 165 | 3.06 | 1.40 | 2.05 | 28 |
| 11 | T562B | 20 | Cotton | 165 | 3.06 | 1.40 | 2.05 | 28 |
| 12 | T562B | 20 | Cotton | 165 | 3.06 | 1.40 | 2.05 | 28 |
| 13 | T169B | 20 | nylon | 140 | 3.06 | 1.29 | 1.70 | 28 |
| 14 | T169B | 20 | nylon | 140 | 3.06 | 1.29 | 1.70 | 28 |
| 15 | T169B | 20 | nylon | 140 | 3.06 | 1.29 | 1.70 | 28 |
| 16 | T169B | 20 | nylon | 140 | 3.06 | 1.29 | 1.70 | 28 |
| 17 | T169B | 20 | nylon | 140 | 3.06 | 1.29 | 1.70 | 28 |
| 18 | T169B | 20 | nylon | 140 | 3.06 | 1.29 | 1.70 | 28 |
| 19 | T562B | 20 | nylon | 140 | 3.06 | 1.29 | 2.90 | 28 |
| 20 | T562B | 20 | nylon | 140 | 3.06 | 1.29 | 2.90 | 28 |
| 21 | T562B | 20 | nylon | 140 | 3.06 | 1.29 | 2.90 | 28 |
| 22 | T562B | 20 | nylon | 140 | 3.06 | 1.29 | 2.90 | 28 |
| 23 | T562B | 20 | nylon | 140 | 3.06 | 1.29 | 2.90 | 28 |
| 24 | T562B | 20 | nylon | 140 | 3.06 | 1.29 | 2.90 | 28 |
| 25 | T562B | 20 | Cotton | 165 | 3.06 | 1.40 | | 28 |

TABLE 1-continued

| KNITTING CONDITIONS | | | | | | | | |
|---|---|---|---|---|---|---|---|---|
| Example | Spandex Lycra ® Type | Lycra ® Denier | Hard Yarn Continuous Filament-Type | Spun Yarn Count, denier | Knitting Stitch Length, L, mm | Cover Factor, Cf | Lycra ® Feed Tension, grams | Machine Gauge, needles per inch |
| 26 | T562B | 20 | Cotton | 165 | 3.06 | 1.40 | | 28 |
| 27 | T562B | 40 | Cotton | 165 | 3.06 | 1.40 | | 28 |
| 28 | T562B | 40 | Cotton | 165 | 3.06 | 1.40 | | 28 |

TABLE 2

| RESULTS | | | | | | | | | |
|---|---|---|---|---|---|---|---|---|---|
| Example | Lycra ® Draft | Lycra ® Content in Fabric by % Weight | Open Width/ Tube | Hydroset Temp ° C. | Hydroset Time minutes | Basis Weight g/m2 | Maximum Elongation % Length × Width | Shrinkage %, Warp by Weft | Face Curl, Fraction of 360° |
| 1 | 2 | 6 | OW | none | none | 219 | 112 × 150 | −3 × −3 | ½ |
| 2 | 2 | 6 | OW | 110 | 5 | 219 | 115 × 158 | −2 × −3 | ½ |
| 3 | 2 | 6 | OW | 130 | 15 | 194 | 95 × 155 | −3 × −3 | ½ |
| 4 | 2 | 6 | tube | none | none | 232 | 97 × 153 | −3 × 2 | ⅜ |
| 5 | 2 | 6 | tube | 110 | 5 | 229 | 98 × 144 | −3 × 2 | ⅜ |
| 6 | 2 | 6 | tube | 130 | 15 | 206 | 80 × 143 | −3 × 3 | ¼ |
| 7 | 2 | 6 | OW | none | none | 220 | 115 × 156 | −2 × −3 | ½ |
| 8 | 2 | 6 | OW | 110 | 5 | 210 | 108 × 156 | −2 × −2 | ½ |
| 9 | 2 | 6 | OW | 130 | 15 | 171 | 74 × 154 | −1 × −1 | ⅜ |
| 10 | 2 | 6 | tube | none | none | 229 | 98 × 156 | −3 × 2 | ½ |
| 11 | 2 | 6 | tube | 110 | 5 | 225 | 97 × 149 | −2 × 2 | ½ |
| 12 | 2 | 6 | tube | 130 | 15 | 173 | 57 151 | −4 × 4 | ½ |
| 13 | 2 | 7 | OW | none | none | 242 | 97 × 123 | −3 × −2 | ⅛ |
| 14 | 2 | 7 | OW | 110 | 5 | 244 | 93 × 117 | −3 × −2 | 0 |
| 15 | 2 | 7 | OW | 130 | 15 | 238 | 71 × 95 | −2 × −4 | ¼ |
| 16 | 2 | 7 | tube | none | none | 254 | 97 × 135 | −2 × 0 | ⅛ |
| 17 | 2 | 7 | tube | 110 | 5 | 258 | 92 × 129 | −1 × 0 | 0 |
| 18 | 2 | 7 | tube | 130 | 15 | 251 | 69 × 106 | −1 × 0 | 0 |
| 19 | 2 | 7 | OW | none | none | 248 | 104 × 120 | −3 × −2 | 0 |
| 20 | 2 | 7 | OW | 110 | 5 | 244 | 98 × 118 | −2 × −2 | 0 |
| 21 | 2 | 7 | OW | 130 | 15 | 209 | 63 × 86 | −2 × −1 | ½ |
| 22 | 2 | 7 | tube | none | none | 260 | 103 × 130 | −2 × 0 | ⅛ |
| 23 | 2 | 7 | tube | 110 | 5 | 258 | 100 × 129 | −2 × 0 | 0 |
| 24 | 2 | 7 | tube | 130 | 15 | 220 | 62 × 102 | −2 × 0 | ⅛ |
| 25 | 3 | 4 | tube | none | none | 300 | 155 × 169 | −2 × 1 | ¼ |
| 26 | 3 | 4 | tube | 130 | 15 | 189 | 88 × 178 | 7 × 4 | ⅝ |
| 27 | 2 | 12 | OW | none | none | 285 | 144 × 138 | −1 × −1 | ½ |
| 28 | 2 | 12 | OW | 130 | 15 | 220 | 101 × 136 | 0 × −2 | ½ |

The broken end detector in each spandex feed path (see FIG. 2) is either adjusted to reduce sensitivity to yarn tension, or removed from the machines for these examples. The broken end detector is a type that contacted the yarn, and therefore induced tension in the spandex.

Example 1

The 20-denier spandex feed tension is 1.5 grams (1.47 cN), which is in the range of 4 to 6 cN. The hard yarn in this example is ring-spun cotton (32 Ne, 165 denier). The fabric is dyed and finished according to the process schematically shown in FIG. 5. The fabric is slit and dried open width as in 63*a*. The fabric basis weight for Example 1 is 219 g/m2.

Example 2

The knit fabric of Example 1 is treated with hot water (230° F. or 110° C.) for 5 minutes in a jet dyer and dyed and finished similarly to Example 1, FIG. 6 as in path 65*a* with hydro-setting step 74. The finished fabric in Example 2 has the same basis weight (weight); elongation, shrinkage, and face curl as the knit fabric in Example 1 even though a hydro-setting step was used to finish the fabric. This example illustrates that even at hydro-setting temperatures, 5 minutes of exposure to hydro setting is not sufficient to change the fabric properties.

Example 3

The knit fabric of Example 1 is treated with hot water (266° F. or 130° C.) for 15 minutes in a jet dyer and dyed and finished similarly to Example 2. The finished fabric in Example 3 has a basis weight of 194 g/m2, which is 11% lower than Example 1.

Example 4

The knit fabric of Example 1 is dyed and finished according to the process schematically shown in FIG. 5. The fabric is dried tubular as in 63*b*. Because the desired fabric weight for tubular goods is around 200 g/m2, this process makes fabric with excessive weight (232 g/m2), even thought all other fabric properties are desirable.

Example 5

The knit fabric of Example 1 is treated with hot water (230° F. or 110° C.) for 5 minutes in a jet dyer and dyed and finished similarly to Example 4, FIG. 6, as in path 65*b* with tubular hydro-setting 74. The finished fabric in Example 5 has a basis weight, which is only 1% lower than the fabric in Example 4. Maximum length elongation, shrinkage, and face curl for Example 5 are the same as the knit fabric in Example 4 even though a hydro-setting step is used to finish the fabric. This example illustrates that even at hydro-setting process conditions (elevated temperature and pressure), 5 minutes of exposure to hydro setting is not sufficient to change the fabric properties.

Example 6

The knit fabric of Example 1 is treated with hot water (266° F. or 130° C.) for 15 minutes in a jet dyer and dyed and finished similarly to Example 5. The finished fabric in Example 6 has a basis weight of 206 g/m2, which is 10% lower than Example 4 and acceptable for the tubular T-shirt garment. Fabric elongation, shrinkage, and face curl also are acceptable for this purpose.

Example 7

Process parameters are the same as in Example 1, except that a different spandex yarn, Lycra® Type 562B ('easy-set') was used for the spandex feed. The results are comparable to the fabric in Example 1.

Example 8

The knit fabric of Example 7 is treated with hot water (230° F. or 110° C.) for 5 minutes in a jet dyer and dyed and finished similarly to Example 1, FIG. 6, as in path 65*a* with tubular hydro-setting step 74. The finished fabric in Example 8 has a basis weight, which is only 5% lower than the fabric in Example 7. Maximum length elongation, shrinkage, and face curl for Example 8 are similar to the knit fabric in Example 7 even though a hydro-setting step was used to finish the fabric. This example illustrates that even at hydro-setting temperatures, 5 minutes of exposure to hydro setting is not sufficient to change the fabric properties.

Example 9

The knit fabric of Example 7 is treated with hot water (266° F. or 130° C.) for 15 minutes in a jet dyer and dyed and finished similarly to Example 1. The knit fabric is processed according to FIG. 6, path 65*a*, to give an open width fabric. This spandex is more sensitive to heat than other grades of Lycra® brand spandex, thus the basis weight for the fabric in Example 9 is 171 g/m2 which is 19% lower than the fabric in example 7. Elongation, Shrinkage, and fabric face curl are acceptable for making T-shirts.

Example 10

The knit fabric of Example 7 is dyed and finished according to the process schematically shown in FIG. 5. The fabric is dried tubular as in 63*b*. Because the desired fabric weight for tubular goods is around 200 g/m2, this process makes fabric with excessive weight (229 g/m2), even thought all other fabric properties are desirable.

Example 11

The knit fabric of Example 7 is treated with hot water (230° F. or 110° C.) for 5 minutes in a jet dyer and dyed and finished similarly to Example 4, FIG. 6 as in 65*b*, with tubular hydro-setting step 74. The finished fabric in Example 11 has a basis weight, which is only 2% lower than the fabric in Example 10. Maximum length elongation, shrinkage, and face curl for Example 11 are the same as the knit fabric in Example 10 even though a hydro-setting step was used to finish the fabric. This example illustrates that even at hydro-setting temperatures, 5 minutes of exposure to hydro setting is not sufficient to change the fabric properties.

Example 12

The knit fabric of Example 7 is treated with hot water (266° F. or 130° C.) for 15 minutes in a jet dyer and dyed and finished similarly to Example 11. The finished fabric in Example 12 has a basis weight of 173 g/m2, which is 23% lower than Example 7 and acceptable for the tubular T-shirt garment. Fabric elongation, shrinkage, and face curl also are acceptable.

Example 13

The 20-denier spandex feed tension was 1.70 grams (1.67 cN), which is in the range of 4 to 6 cN. The hard yarn in this example was textured nylon (140 denier/48 filaments). The fabric was dyed and finished, FIG. 5. The fabric was slit and dried open width as in 63*a*. The fabric basis weight for Example 13 is 242 g/m2.

Example 14

The knit fabric of Example 13 is treated with hot water (230° F. or 110° C.) for 5 minutes in a jet dyer and dyed and finished similarly to Example 13, FIG. 6, path 65*a* with hydro-setting step, 74. The finished fabric in Example 14 has the same basis weight (weight); elongation, shrinkage, and face curl as the knit fabric in Example 13 even though a hydro-setting step was used to finish the fabric. This example illustrates that even at hydro-setting temperatures, 5 minutes of exposure to hydro setting is not sufficient to change the fabric properties.

Example 15

The knit fabric of Example 13 is treated with hot water (266° F. or 130° C.) for 15 minutes in a jet dyer and dyed and finished similarly to Example 14. The finished fabric in Example 15 has warp elongation that is reduced significantly (>25%) versus the finished fabric in Example 13.

Example 16

The knit fabric of Example 13 is dyed and finished according to method schematically shown in FIG. 5. The fabric is dried tubular as in 63*b*.

Example 17

The knit fabric of Example 13 is treated with hot water (230° F. or 110° C.) for 5 minutes in a jet dyer and dyed and finished similarly to Example 16, FIG. 6, path 65*b* with tubular hydro-setting step 74. The finished fabric in Example 17 has a warp elongation which is only 5% lower than Example 16. Fabric basis weight, shrinkage, and face curl for Example 17 are essentially the same as the knit fabric in Example 16 even though a hydro-setting step is used to finish the fabric. This example illustrates that even at hydro-setting temperatures, 5 minutes of exposure to hydro setting is not sufficient to change the fabric properties.

Example 18

The knit fabric of Example 13 is treated with hot water (266° F. or 130° C.) for 15 minutes in a jet dyer and dyed and finished similarly to Example 17. The finished fabric in Example 18 has a warp elongation of 69%, which is 28% lower than Example 16 and acceptable for the tubular T-shirt garment. Fabric basis weight, shrinkage, and face curl also were essentially the same as Example 16.

Example 19

Process parameters are the same as in Example 13, except that a different spandex yarn, Lycra® Type 562B ('easy-set') was used for the spandex feed. The results were comparable to those of Example 13.

Example 20

The knit fabric of Example 19 is treated with hot water (230° F. or 110° C.) for 5 minutes in a jet dyer and dyed and finished similarly to Example 19, FIG. 6, path 65*a* with tubular hydro-setting step 74. The finished fabric in Example 20 has a basis weight, which is only 2% lower than that of Example 19. Maximum length elongation, shrinkage, and face curl for Example 20 are similar to the knit fabric in Example 19 even though a hydro-setting step was used to finish the fabric. This example illustrates that even at hydro-setting temperatures, 5 minutes of exposure to hydro setting is not sufficient to change the fabric properties.

Example 21

The knit fabric of Example 19 is treated with hot water (266° F. or 130° C.) for 15 minutes in a jet dyer and dyed and finished similarly to Example 20. The knit fabric was processed according to FIG. 6, 65*a* to give an open width fabric. This spandex is more sensitive to heat than other grades of Lycra® brand spandex, thus the basis weight for the fabric in Example 21 is 209 g/m2 which is 14% lower than the fabric in example 19. Elongation, Shrinkage, and fabric face curl were acceptable.

Example 22

The knit fabric of Example 19 is dyed and finished according to the process schematically shown in FIG. 5. The fabric is dried tubular as in 63*b*. This process makes fabric with excessive weight (260 g/m2), even thought all other fabric properties are desirable.

Example 23

The knit fabric of Example 19 is treated with hot water (230° F. or 110° C.) for 5 minutes in a jet dyer and dyed and finished similarly to Example 22, FIG. 6, path 65*b* with tubular hydro-setting step 74. The finished fabric in Example 23 has a basis weight, which is only 1% lower than the fabric in Example 22. Maximum length elongation, shrinkage, and face curl for Example 23 are the same as the knit fabric in Example 22 even though a hydro-setting step is used to finish the fabric. This example illustrates that even at hydro-setting temperatures, 5 minutes of exposure to hydro setting is not sufficient to change the fabric properties.

Example 24

The knit fabric of Example 19 is treated with hot water (266° F. or 130° C.) for 15 minutes in a jet dyer and dyed and finished similarly to Example 23. The finished fabric in Example 24 has a basis weight of 220 g/m2, which is 15% lower than Example 22.

Example 25

The 20-denier spandex draft is 3.0×. The hard yarn in this example is ring-spun cotton (32 Ne, 165 denier). The fabric is dyed and finished according to the process schematically shown in FIG. 5. The fabric is dried tubular as in 63*b*. The fabric basis weight for Example 25 is 300 g/m2.

Example 26

The knit fabric of Example 25 is treated with hot water (266° F. or 130° C.) for 15 minutes in a jet dyer and dyed and finished similarly to Example 25, FIG. 6, path 65*b* with tubular hydro-setting step 74. The finished fabric in Example 26 has a basis weight, which is 37% lower than the fabric in Example 25.

Example 27

The 40-denier spandex draft is 2.0×. The hard yarn in this example is ring-spun cotton (32 Ne, 165 denier). The fabric is dyed and finished according to the process schematically shown in FIG. 5. The fabric is slit and dried open width as in 63*a*. The fabric basis weight for Example 27 is 285 g/m2.

Example 28

The knit fabric of Example 27 is treated with hot water (266° F. or 130° C.) for 15 minutes in a jet dyer and dyed and finished similarly to Example 27, FIG. 6, path 65*a* with tubular hydro-setting step 74. The finished fabric in Example 28 has a basis weight, which is 23% lower than the fabric in Example 25.

We claim:

1. A circular knit, elastic, single jersey fabric made by the steps of:

a. providing a spandex yarn;

b. providing at least one hard yarn selected from the group consisting of spun yarns, continuous filament yarns and combinations thereof;

c. plating the spandex yarn with the at least one hard yarn;

d. circular knitting the plated elastomeric material and at least one hard yarn in every knit course to form a circular knit, elastic, single jersey fabric; and e. contacting the circular knit, elastic, single jersey fabric with a continuous phase aqueous solution under conditions of temperature and pressure and for a period of time sufficient to substantially set the spandex yarn.

2. The circular knit, elastic, single jersey fabric of claim 1, wherein the spandex yarn is further defined as bare spandex yarn.

3. The circular knit, elastic, single jersey fabric of claim 1, wherein the at least one hard yarn is selected from the group consisting of cotton and a cotton blend, and the circular knit, elastic, single jersey fabric has a basis weight of from about 100 to about 400 g/m$^2$.

4. The circular knit, elastic, single jersey fabric of claim 1, wherein the circular knit, elastic, single jersey fabric has a shrinkage of about 14% or less after washing.

5. The circular knit, elastic, single jersey fabric of claim 1, wherein the circular knit, elastic, single jersey fabric is produced in the form of a tube and has substantially no visible side creases formed therein.

6. A garment made from the circular knit, elastic, single jersey fabric of claim 1.

7. The garment of claim 6, wherein the spandex yarn is further defined as bare spandex yarn.

8. The garment of claim 6, wherein the at least one hard yarn is selected from the group consisting of cotton and a cotton blend, and the circular knit, elastic, single jersey fabric has a basis weight of from about 100 to about 400 g/m$^2$.

9. The garment of claim 6, wherein the circular knit, elastic, single jersey fabric has a shrinkage of about 14% or less after washing.

10. A circular knit, elastic, single jersey fabric, comprising bare spandex yarn in every course and at least one hard yarn, that has been exposed to temperature no higher than about 160° C. as shown by differential scanning calorimetry or molecular weight analysis of the spandex and exhibits wash shrinkage of less than about 15%; wherein said fabric has received a single stabilization step including contacting the fabric with a continuous phase aqueous solution.

11. The fabric of claim 10, wherein the bare spandex yarn is present in the circular knit, elastic, single jersey fabric in an amount from about 3.5% to about 14% by weight based on the total fabric weight per square meter.

12. The fabric of claim 10, wherein the circular knit, elastic, single jersey fabric has a cover factor of about 1.4.

13. The fabric of claim 10, further comprising at least one further treatment step selected from the group consisting of drying, compacting, and combinations thereof, and wherein the circular knit, elastic fabric is subjected to an overfeed in its length during the at least one further treatment step.

14. The fabric of claim 10, further comprising the step of exposing the circular knit, elastic, single jersey fabric to a treatment step, wherein such treatment step occurs at a temperature below about 160° C.

15. The fabric of claim 10, wherein the treatment step is selected from the group consisting of cleaning, bleaching, dyeing, drying, compacting, and any combination thereof.

16. The fabric of claim 10, wherein the circular knit, elastic, single jersey fabric is produced in the form of a tube and has substantially no visible side creases formed therein.

17. The circular knit, elastic, single jersey fabric of claim 10, wherein the at least one hard yarn is cotton or a cotton blend, and the circular knit, elastic, single jersey fabric has a basis weight of from about 100 to about 400 g/m$^2$.

18. The circular knit, elastic, single jersey fabric of claim 10, wherein the circular knit, elastic, single jersey fabric has an elongation of at least about 60% in a warp direction thereof.

19. The circular knit, elastic, single jersey fabric of claim 10, wherein the circular knit, elastic, single jersey fabric has a shrinkage of about 14% or less after washing.

20. A garment made from the circular knit, elastic, single jersey fabric of claim 10.

* * * * *